US008534907B2

(12) United States Patent
Yum

(10) Patent No.: US 8,534,907 B2
(45) Date of Patent: Sep. 17, 2013

(54) DEVICE FOR ACCELERATING MIXING AND DISSOLVING PROCESS OF LIQUID WATER

(75) Inventor: Jong Bok Yum, Hwasung-si (KR)

(73) Assignee: Ostar Tech Co., Ltd., Kyunggi-do (KR)

( * ) Notice: Subject to any disclaimer, the term of this patent is extended or adjusted under 35 U.S.C. 154(b) by 0 days.

(21) Appl. No.: 13/526,473

(22) Filed: Jun. 18, 2012

(65) Prior Publication Data

US 2013/0088933 A1 Apr. 11, 2013

(30) Foreign Application Priority Data

Oct. 11, 2011 (KR) ..... 10-2011-0103363

(51) Int. Cl.
*B01F 5/10* (2006.01)
*B01F 5/12* (2006.01)

(52) U.S. Cl.
USPC ..... 366/165.3; 366/262; 366/263; 366/279

(58) Field of Classification Search
USPC ..... 366/165.1, 165.3, 262, 263, 270, 366/167.2, 168.1, 168.2, 169.1, 169.2, 296, 366/293, 279, 241, 330.1, 331
See application file for complete search history.

(56) References Cited

U.S. PATENT DOCUMENTS

| | | | | | |
|---|---|---|---|---|---|
| 1,764,498 | A | * | 6/1930 | Beers | 366/196 |
| 1,992,447 | A | * | 2/1935 | Savy | 366/263 |
| 2,778,614 | A | * | 1/1957 | Koch | 366/296 |
| 2,793,847 | A | * | 5/1957 | Steele | 261/89 |
| 3,147,957 | A | * | 9/1964 | Martin | 366/263 |
| 3,913,894 | A | * | 10/1975 | McFarren | 366/76.3 |
| 4,100,610 | A | * | 7/1978 | Johnston et al. | 366/102 |
| 4,209,259 | A | * | 6/1980 | Rains et al. | 366/273 |
| 4,900,159 | A | * | 2/1990 | Jamison | 366/343 |
| 4,993,841 | A | * | 2/1991 | Lofgren et al. | 366/274 |
| 5,078,505 | A | * | 1/1992 | Nyman et al. | 366/262 |
| 5,141,327 | A | * | 8/1992 | Shiobara | 366/274 |
| 5,393,142 | A | * | 2/1995 | Meier | 366/274 |
| 5,478,149 | A | * | 12/1995 | Quigg | 366/273 |
| D366,935 | S | * | 2/1996 | Arthun et al. | D23/411 |
| 5,758,965 | A | * | 6/1998 | Gambrill et al. | 366/273 |

(Continued)

FOREIGN PATENT DOCUMENTS

| | | |
|---|---|---|
| KR | 10-2004-0057094 A | 7/2004 |
| KR | 10-0456335 | 10/2004 |

(Continued)

OTHER PUBLICATIONS

Request for Examination (Preferential Examination) submitted before KIPO, 19pgs, with translation, 2011.

*Primary Examiner* — Tony G Soohoo
(74) *Attorney, Agent, or Firm* — Rabin & Berdo, P.C.

(57) ABSTRACT

A device for accelerating mixing and dissolving processes of liquid water and powder. The device includes a main body formed in a bottle cap shape including a top surface and a side periphery surface, and a shaft disposed at a center of an upper portion of the main body in such a manner as to be inserted into a shaft insertion groove formed at a center of an impeller. The top surface of the main body has two or more introducing portions to introduce the liquid water and the powder into the device, and the side periphery surface of the main body has two or more discharging portions to discharge the liquid water and the powder introduced into the device through the two or more introducing portions to the outside of the device.

2 Claims, 2 Drawing Sheets

(56) References Cited

U.S. PATENT DOCUMENTS

| | | | | |
|---|---|---|---|---|
| 6,206,562 | B1 * | 3/2001 | Eyraud et al. | 366/273 |
| 7,396,153 | B2 * | 7/2008 | Andersson | 366/273 |
| 7,513,680 | B2 * | 4/2009 | Reusche et al. | 366/273 |
| D596,309 | S * | 7/2009 | Tien et al. | D24/220 |
| 7,954,992 | B2 * | 6/2011 | Tytar | 366/129 |
| 8,128,277 | B2 * | 3/2012 | Meier | 366/273 |
| 8,282,267 | B2 * | 10/2012 | Castillo et al. | 366/262 |
| 2006/0221765 | A1 * | 10/2006 | Andersson | 366/273 |
| 2010/0046323 | A1 * | 2/2010 | Tien et al. | 366/274 |

FOREIGN PATENT DOCUMENTS

| | | | |
|---|---|---|---|
| KR | 10-0680037 | | 2/2007 |
| KR | 20-0441163 | B1 | 7/2008 |
| KR | 10-2011-0049455 | A | 5/2011 |

* cited by examiner

DEVICE FOR ACCELERATING MIXING AND DISSOLVING PROCESS OF LIQUID WATER

BACKGROUND OF THE INVENTION

1. Field of the Invention

The present invention relates to a device for accelerating mixing and dissolving processes of liquid water and powder poured into the water, and more particularly, to a device for accelerating mixing and dissolving processes of liquid water that is adapted to be mounted on a planetary impeller for a mixer as the existing liquid water dissolving device to more rapidly mix and dissolve the liquid water and the powder poured in the water.

2. Background of the Related Art

Typically, a liquid water mixer, which is adapted to mix two or more kinds of liquid water and powder inclusive of syringe liquid, includes a mixer body, and an impeller having a plurality of through-holes formed thereon shaft-disposed on the mixer body so as to uniformly mix the two kinds of liquid water supplied to the mixer body, a shaft adapted to connect an output shaft of a motor disposed at one side of the impeller to a housing by means of a bearing so as to rotate the impeller, and a plurality of sealing means like O-rings adapted to prevent the liquid water from being introduced into the shaft disposed on the mixer body and the housing. According to the conventional mixer, however, the driving unit for driving the motor and the impeller is complicated in configuration, which raises the manufacturing cost and makes it hard to perform the assembling and manufacturing processes, and after the mixing has been finished, further, if the mixture is left for a predetermined period of time, the mixed liquid water is hardened into the mixer body, which causes the rotation of the impeller to be interfered. Thus, if the impeller is not driven by means of the interference of the hardened mixture, overload is applied to the motor to cause serious troubles such as malfunctions, breakdown of impeller, electrical leakage, and the like. So as to solve the above-mentioned problems, therefore, there has been proposed Korean Patent No. 017951 entitled 'planetary impeller for a mixer', wherein the impeller is open on the top portion thereof in such a manner as to form cooling passages inwardly from the open top portion thereof, through which cooling water is introduced, and a plurality of blades is formed radially along the outer periphery of the impeller in such a manner as to be brought into partial contact with the outer periphery of the impeller, while the upper and lower sides of each blade being spaced apart from the outer periphery of the impeller, thereby preventing foreign matters from being naturally accumulated on the impeller through the vortexes generated by the rotation of the impeller, optimizing the effects of the vortexes generated during the rotation of the impeller, and greatly improving the mixing efficiency of the mixer.

The prior art, Korean Patent No. 017951 provides an excellent dissolving efficiency, but if the dissolving time is more shortened, the productivity can be more improved. Therefore, there is a need for the development of a device capable of more reducing the dissolving time.

SUMMARY OF THE INVENTION

Accordingly, the present invention has been made in view of the above-mentioned problems occurring in the prior art, and it is an object of the present invention to provide a device for accelerating mixing and dissolving processes of liquid water that is adapted to be mounted on a planetary impeller for a mixer, as disclosed in Korean Patent No. 017951, to more rapidly mix and dissolve the liquid water and the powder poured in the water.

To accomplish the above object, according to the present invention, there is provided a device for accelerating mixing and dissolving processes of liquid water and powder, which is adapted to be mounted to cover an impeller therewith, the impeller having an output shaft disposed on a shaft of a motor, a fixing means fitted around the top end periphery of the output shaft, a bearing shaft fitted to the top end periphery of the fixing means, a plurality of blades formed radially along the outer periphery of an impeller body coupled to the bearing shaft, and two or more cooling passages formed on the top surface of the impeller body so as to introduce cooling water thereinto. The device includes a main body formed in a bottle cap shape including a top surface and a side periphery surface, and a shaft disposed at a center of an upper portion of the main body in such a manner as to be inserted into a shaft insertion groove formed at a center of an impeller. The top surface of the main body has two or more introducing portions to introduce the liquid water and the powder into the device, and the side periphery surface of the main body has two or more discharging portions to discharge the liquid water and the powder introduced into the device through the two or more introducing portions to the outside of the device.

BRIEF DESCRIPTION OF THE DRAWINGS

The above and other objects, features and advantages of the present invention will be apparent from the following detailed description of the preferred embodiments of the invention in conjunction with the accompanying drawings, in which.

DETAILED DESCRIPTION OF THE PREFERRED EMBODIMENT

The present invention relates to a device for accelerating mixing and dissolving processes of liquid water that is adapted to be mounted on a planetary impeller for a mixer as the existing liquid water dissolving device to more rapidly mix and dissolve the liquid water and the powder poured in the water. Hereinafter, an explanation on the device according to the present invention will be in detail given with reference to the attached drawings.

Figure 1:
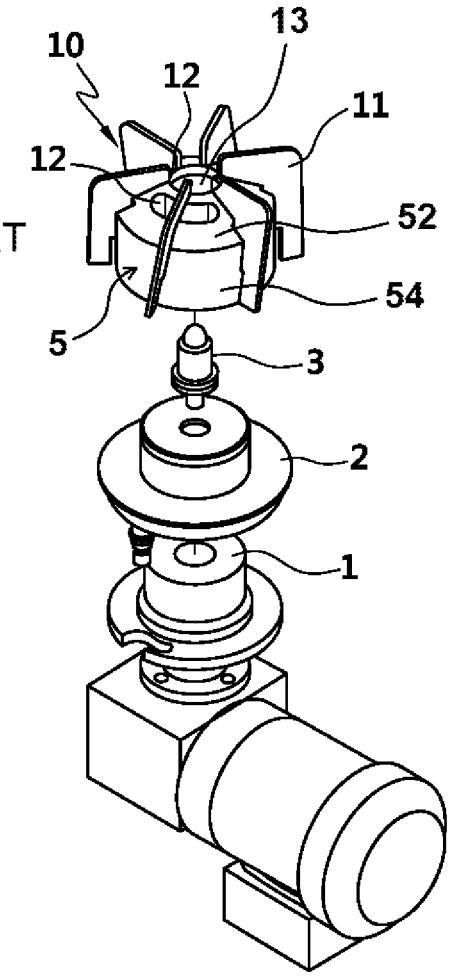
FIG. 1 PRIOR ART
FIG. 1 is an exploded perspective view showing the existing impeller for a mixer.
Figure 2:
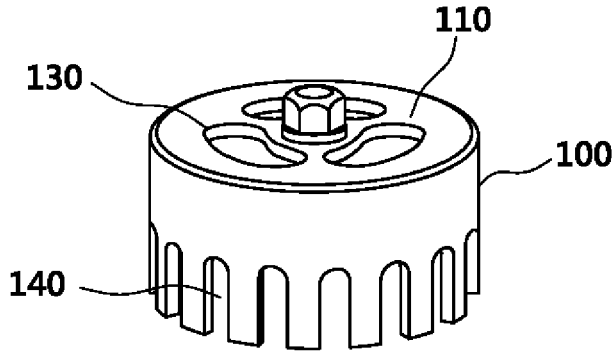
FIG. 2 is a perspective view showing a device for accelerating mixing and dissolving processes of liquid water according to the present invention.
Figure 3:
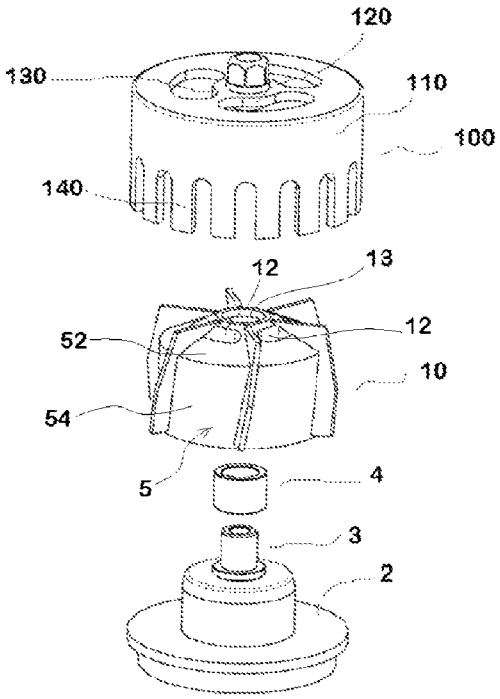
FIG. 3 is an exploded perspective view showing the device according to the present invention mounted on an impeller.
Figure 4:
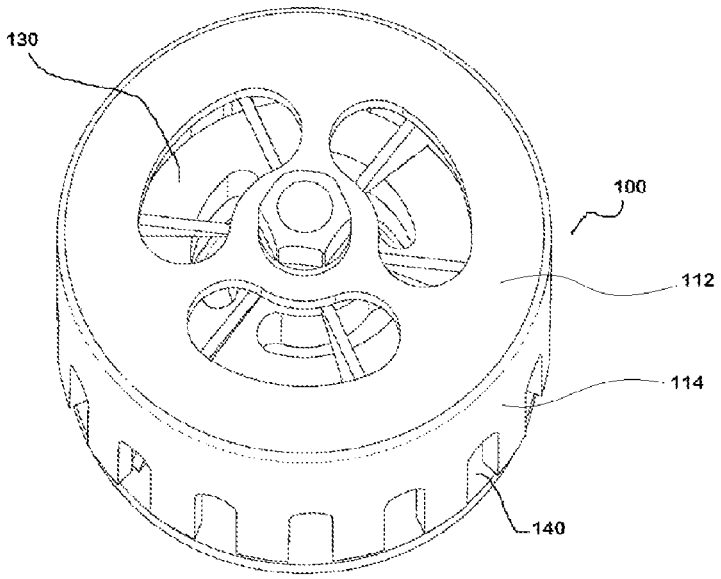
FIG. 4 is a perspective view showing the state where the device according to the present invention has been mounted on the impeller.

FIG. 1 is an exploded perspective view showing the existing impeller for a mixer, FIG. 2 is a perspective view showing a device for accelerating mixing and dissolving processes of liquid water according to the present invention, FIG. 3 is an exploded perspective view showing the device according to the present invention mounted on an impeller, and FIG. 4 is a perspective view showing the state where the device according to the present invention has been mounted on the impeller.

As shown in FIG. 2, a device 100 for accelerating mixing and dissolving processes of liquid water according to the present invention includes: a main body 110 formed in a bottle-cap shape including a top surface and a side periphery surface; a shaft 120 disposed at the center of the upper portion of the main body 110 in such a manner as to be inserted into a shaft insertion groove 13 formed at the center of an impeller 10 to rotate the device 100 in the opposite direction to the rotating direction of the impeller 10; two or more introducing portions 130 formed on the top surface of the main body 110 to introduce the liquid water and the powder into the device 100; and two or more discharging portions 140 formed along the side periphery surface of the main body 110 to discharge the liquid water and the powder introduced into the device 100 through the two or more introducing portions 130 to the outside of the device 100.

Now, an explanation on the operation of the device according to the present invention will be given.

First, the impeller 10 as disclosed in Korean Patent No. 017951 is disposed inside a tank (not shown) into which the liquid water and another liquid water, or the liquid water and powder (hereinafter, referred simply to as 'liquid water') are contained. As shown in FIGS. 1 and 3, the impeller 10 has an output shaft 1 disposed on a shaft of a motor, a fixing means 2 fitted around the top end periphery of the output shaft 1, a bearing shaft 3 fitted to the top end periphery of the fixing means 2, a bearing 4 to be disposed around the bearing shaft 3, and a plurality of blades 11 formed radially along the outer periphery of an impeller body 5 coupled to the bearing shaft 3. The impeller body 5 includes a top surface 52 and a side surface 54. Two or more cooling passages 12 are formed on the top surface 52 of the impeller body 5 so as to introduce cooling water into the impeller body 5. The impeller 10 further includes a shaft insertion groove 13. And, the main body 110 of the device 100 according to the present invention is provided to cover the impeller 10 from the top side thereof. Next, the shaft 120 of the device 100 is inserted into the shaft insertion groove 13 of the impeller 10 and serves to rotate the device 100 in the opposite direction to the rotating direction of the impeller 10. The method for rotating the device 100 in the opposite direction to the rotating direction of the impeller 10 is well known in the art, and therefore, it is not explained anymore for the brevity of the description.

After that, the impeller 10 rotates the liquid water existing inside the tank to generate vortexes by which the liquid water is mixed, and the liquid water mixed inside the tank is sucked into the vortexes generated by the rotation of the device 100 according to the present invention. Next, the liquid water is rotatingly introduced into the device 100 according to the present invention through the two or more introducing portions 130 and is more rapidly rotated by means of the impeller 10, thereby allowing the mixing and dissolving processes of the liquid water to be accelerated. As shown in FIG. 4, the main body 110 of the device 100 has a top surface 112 and a side periphery surface 114, and the top surface 112 has the two or more introducing portions 130. The mixed and dissolved liquid water is pushed by the liquid water continuously introduced through the two or more discharging portions 140 and is discharged to the interior of the tank. The discharged liquid water to the interior of the tank is mixed with the liquid water existing in the interior of the tank. The mixed and dissolved liquid water is introduced again into the device 100 according to the present invention through the two or more introducing portions 130 and is mixed and dissolved again inside the device 100. Next, the mixed and dissolved liquid water is discharged again through the two or more discharging portions 140. The processes are repeatedly carried out.

The mixing and dissolving processes of the liquid water are carried out repeatedly through the device 100 as well as the impeller 10, so that the liquid water can be more rapidly mixed. In more detail, the mixing and dissolving processes of the liquid water through only the impeller 10 are carried out for 15 to 20 minutes, but the mixing and dissolving processes of the liquid water through both of the device 100 and the impeller 10 are carried out just for 3 to 5 minutes, which greatly reduces the time required for the mixing and dissolving processes of the liquid water.

As described above, there is provided the device for accelerating mixing and dissolving processes of liquid water that is adapted to be mounted on the planetary impeller for the existing mixer, thereby substantially reducing the mixing and dissolving time carried out for 15 to 20 minutes to that for 3 to 5 minutes.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A device for accelerating mixing and dissolving processes of liquid water and powder, which is adapted to be mounted to cover an impeller therewith, the impeller having an output shaft disposed on a motor, a fixing means fitted around the top end periphery of the output shaft, a bearing shaft fitted to the top end periphery of the fixing means, a plurality of blades formed radially along the outer periphery of an impeller body coupled to the bearing shaft, and two or more cooling passages formed on the top surface of the impeller body so as to introduce cooling water thereinto, the device comprising:

a main body formed in a bottle cap shape including a top surface and a side periphery surface; and a shaft disposed at a center of an upper portion of the main body in such a manner as to be inserted into a shaft insertion groove formed at a center of the impeller, wherein:

the top surface of the main body has two or more introducing portions to introduce the liquid water and the powder into the device; and the side periphery surface of the main body has two or more discharging portions to discharge the liquid water and the powder introduced into the device through the two or more introducing portions to the outside of the device.

2. An apparatus for accelerating mixing and dissolving processes of liquid water and powder, the apparatus comprising:

an impeller having a bottle-cap-shaped impeller body provided with a top surface and a side surface, a plurality of blades formed radially along an outer periphery of the impeller body, two or more cooling passages formed on the top surface of the impeller body, and a shaft insertion groove formed on the top surface of the impeller body;

a main body formed in a bottle cap shape including a top surface and a side periphery surface; and a shaft disposed at a center of an upper portion of the main body, the shaft being inserted into the shaft insertion groove of the impeller, wherein:

the top surface of the main body has two or more introducing portions to introduce the liquid water and the powder into the device; and the side periphery surface of the main body has two or more discharging portions to discharge the liquid water and the powder introduced into the device to the outside of the device.

* * * * *